US007807950B2

(12) United States Patent
Watkins

(10) Patent No.: US 7,807,950 B2
(45) Date of Patent: Oct. 5, 2010

(54) MICROWAVE SUSCEPTOR FOR FOOD PACKAGING

(76) Inventor: Jeffrey T. Watkins, 14551 268th Ave. NW., Zimmerman, MN (US) 55398-8862

( * ) Notice: Subject to any disclaimer, the term of this patent is extended or adjusted under 35 U.S.C. 154(b) by 0 days.

(21) Appl. No.: 11/156,147

(22) Filed: Jun. 17, 2005

(65) Prior Publication Data

US 2006/0000828 A1 Jan. 5, 2006

Related U.S. Application Data

(60) Provisional application No. 60/580,979, filed on Jun. 17, 2004.

(51) Int. Cl.
*H05B 6/80* (2006.01)

(52) U.S. Cl. ..... 219/730; 219/725

(58) Field of Classification Search ..... 219/730, 219/725, 726, 727, 728, 729, 731, 732, 733, 219/734, 735

See application file for complete search history.

(56) References Cited

U.S. PATENT DOCUMENTS

| | | | |
|---|---|---|---|
| 2,766,923 | A | 10/1956 | Esposito |
| 2,925,210 | A | 2/1960 | Fallert |
| 2,932,438 | A | 4/1960 | Smith |
| 3,066,844 | A | 12/1962 | Moore |
| 4,015,085 | A | 3/1977 | Woods |
| 4,036,423 | A | 7/1977 | Gordon |
| 4,038,425 | A | 7/1977 | Brandberg |
| 4,210,674 | A | 7/1980 | Mitchell |
| 4,268,738 | A | 5/1981 | Flautt, Jr. et al. |
| 4,279,933 | A | 7/1981 | Austin et al. |
| 4,448,309 | A | 5/1984 | Roccaforte |
| 4,453,665 | A | 6/1984 | Roccaforte |
| 4,553,010 | A | 11/1985 | Bohrer |
| 4,592,914 | A | 6/1986 | Kuchenbecker |
| 4,641,005 | A | 2/1987 | Seiferth |
| 4,678,882 | A | 7/1987 | Bohrer |
| 4,734,288 | A | 3/1988 | Engstrom |
| 4,825,025 | A | 4/1989 | Seiferth |
| 4,833,007 | A | 5/1989 | Huang |
| 4,861,958 | A | 8/1989 | Bohrer |
| 4,914,266 | A | 4/1990 | Parks et al. |
| 4,970,358 | A | 11/1990 | Brandberg et al. |

(Continued)

FOREIGN PATENT DOCUMENTS

| | | |
|---|---|---|
| EP | 0205304 B1 | 12/1986 |

(Continued)

OTHER PUBLICATIONS

PCT International Search Report for PCT/US04/27971 dated Mar. 28, 2005 issued by U.S. International Searching Authority.

(Continued)

*Primary Examiner*—Daniel Robinson
(74) *Attorney, Agent, or Firm*—Howrey LLP

(57) ABSTRACT

The present invention relates to a susceptor for the microwave heating of food products that includes a metallized component and a printed component. In another aspect, the invention relates to a method of fabricating a susceptor for the microwave heating of food products that includes a metallized component and a printed component.

8 Claims, 4 Drawing Sheets

U.S. PATENT DOCUMENTS

| | | | | |
|---|---|---|---|---|
| 5,008,024 | A | 4/1991 | Watkins | |
| 5,038,009 | A | 8/1991 | Babbitt | |
| 5,097,107 | A | 3/1992 | Watkins | |
| 5,132,144 | A | 7/1992 | Parks | |
| 5,171,594 | A | 12/1992 | Babbitt | |
| 5,175,031 | A | 12/1992 | Ochocki | |
| 5,214,257 | A | 5/1993 | Riskey | |
| 5,217,765 | A | 6/1993 | Parks | |
| 5,231,268 | A | 7/1993 | Hall et al. | |
| 5,241,150 | A * | 8/1993 | Garvey et al. | 219/725 |
| 5,285,040 | A | 2/1994 | Brandberg et al. | |
| 5,334,820 | A | 8/1994 | Risch | |
| 5,338,911 | A | 8/1994 | Brandberg et al. | |
| 5,428,209 | A | 6/1995 | Babu et al. | |
| 5,565,125 | A | 10/1996 | Parks | |
| 6,320,172 | B1 | 11/2001 | Watkins | |
| 6,586,715 | B2 | 7/2003 | Watkins | |
| 6,677,563 | B2 * | 1/2004 | Lai | 219/728 |
| 6,870,145 | B2 | 3/2005 | Watkins | |
| 6,906,299 | B2 | 6/2005 | Watkins | |
| 6,919,547 | B2 * | 7/2005 | Tsontzidis et al. | 219/730 |
| 2003/0085224 | A1 * | 5/2003 | Tsontzidis et al. | 219/730 |
| 2003/0111463 | A1 * | 6/2003 | Lai | 219/728 |
| 2005/0205565 | A1 * | 9/2005 | Cole et al. | 219/730 |
| 2005/0230384 | A1 * | 10/2005 | Robison et al. | 219/730 |

FOREIGN PATENT DOCUMENTS

| | | | |
|---|---|---|---|
| EP | 0317203 | B1 | 5/1989 |
| EP | 032094 | A2 | 6/1989 |
| EP | 0451530 | A2 | 10/1991 |
| FR | 1399151 | A | 4/1965 |
| GB | 841015 | | 7/1960 |
| GB | 2046060 | A | 11/1980 |
| WO | WO 91/15096 | | 10/1991 |
| WO | WO 96/36546 | | 11/1996 |

OTHER PUBLICATIONS

The International Search Examination Report for PCT/US05/21314, Date of mailing Aug. 10, 2006.

* cited by examiner

MICROWAVE SUSCEPTOR FOR FOOD PACKAGING

CROSS REFERENCE TO RELATED APPLICATION

This application claims the benefit of U.S. Provisional Application No. 60/580,979, filed Jun. 17, 2004, which is incorporated herein by reference.

FIELD OF THE INVENTION

This application relates generally to microwave cooking, and in particular, to microwave susceptors used in packaging for microwave foods.

BACKGROUND

While appropriate for many applications, conventional microwave susceptors generally have just one temperature output. In addition to having no temperature regulation, conventional susceptors often do not generate enough heat to achieve adequate browning and crisping, or in some instances, cook food unevenly, burning the food in some areas while under cooking the food in others. The following is a comparison to the three known susceptor types: 1) fully metallized film; 2) demetallized film; and 3) printed susceptors.

Fully metallized thin film susceptors have one heat output across the entire surface. This lack of control results in overcooking certain areas of the food (such as the edge of a pizza) while undercooking the center. Additionally, the amount of heat generated is not sufficient to compare favorably with traditional cooking methods such as baking.

Demetallized susceptors address the lack of control by reducing heat in areas that tend to overcook. While this can be effective, the result is slower preparation time and improper browning. Area heat is reduced by removing metal (demetallizing) in the areas where the food is being overcooked, resulting in less browning. While demetallization can provide balanced cooking results for some foods, the results still fall short of traditional cooking methods because thin film metallized susceptors do not provide the heat required to properly brown many foods.

The third style of susceptor is printed. While printed susceptors have been used experimentally, they have not enjoyed much commercial use. The reason for this is that known printed susceptors generally lack the temperature regulation to assure that the package does not "runaway heat", which can result in the package catching fire. Printed susceptors lack the natural "thermostat" that is inherent in film susceptors. That is, when a metallized film reaches a certain temperature it naturally cracks and reduces its heat output. In contrast, printed susceptors absorb energy as long as microwave energy is applied to it. The result can be package ignition.

SUMMARY OF THE INVENTION

In certain aspects, the present invention provides a microwave susceptor comprising a metallized film, a microwave-interactive coating applied to the metallized film, a substrate, and a laminating adhesive layer holding the printed metallized film to the substrate. The metallized film may be selected from the group consisting of fully metallized, partially metallized, demetallized, and variable density metallized. The metallized film may be a polyester film with a vacuum-deposited aluminum layer. The substrate may be paperboard or another acceptable non-microwave-interactive substance. The substrate may be a portion of a microwave food container, such as the floor portion or the portion upon which the microwave food is seated.

In other aspects, the present invention provides a method of fabricating a microwave susceptor in which a microwave-interactive layer and a non-microwave-interactive layer are nipped together between one or more rollers or by other means of compression. The microwave-interactive layer is prepared by applying a microwave-interactive coating to a metallized film, such as a polyester film with a vacuum-deposited aluminum layer. The metallized film may be selected from the group consisting of fully metallized, partially metallized, demetallized, and variable density metallized. The non-microwave-interactive layer is prepared by applying a laminating adhesive to a substrate having an upper face and a lower face. The laminating adhesive is applied to the upper face of the substrate. Preferably, the laminating adhesive is applied to cover the entire upper face of the substrate. Preferably, the microwave-interactive coating is dried before nipping the microwave-interactive layer and the non-microwave-interactive layer. The substrate may be paperboard or another acceptable non-microwave-interactive substance. The substrate may be a portion of a microwave food container, such as the floor portion or the portion upon which the microwave food is seated. The microwave-interactive coating may contain one or more components selected from the group consisting of carbon, graphite, metal, and metal oxide. In a preferred embodiment, the microwave-interactive coating is a carbon-based coating. The coating may be press-applied. The microwave-interactive coating may be a dispersion or other mixture containing the microwave-interactive component as well as other components such as an adhesive, which may be a water-based adhesive. The microwave-interactive coating may be applied selectively to one or more portions of the metallized film.

DETAILED DESCRIPTION

The improved susceptor disclosed herein addresses the above shortcomings of known microwave susceptors by providing a susceptor structure that includes a metallization layer in combination with a printed susceptor. This structure increases heat in areas where it is needed, such as the center of a pizza or the middle of an egg roll. The disclosed susceptor can achieve results comparable to conventional cooking with the speed and convenience of microwave cooking.

Figure 1:
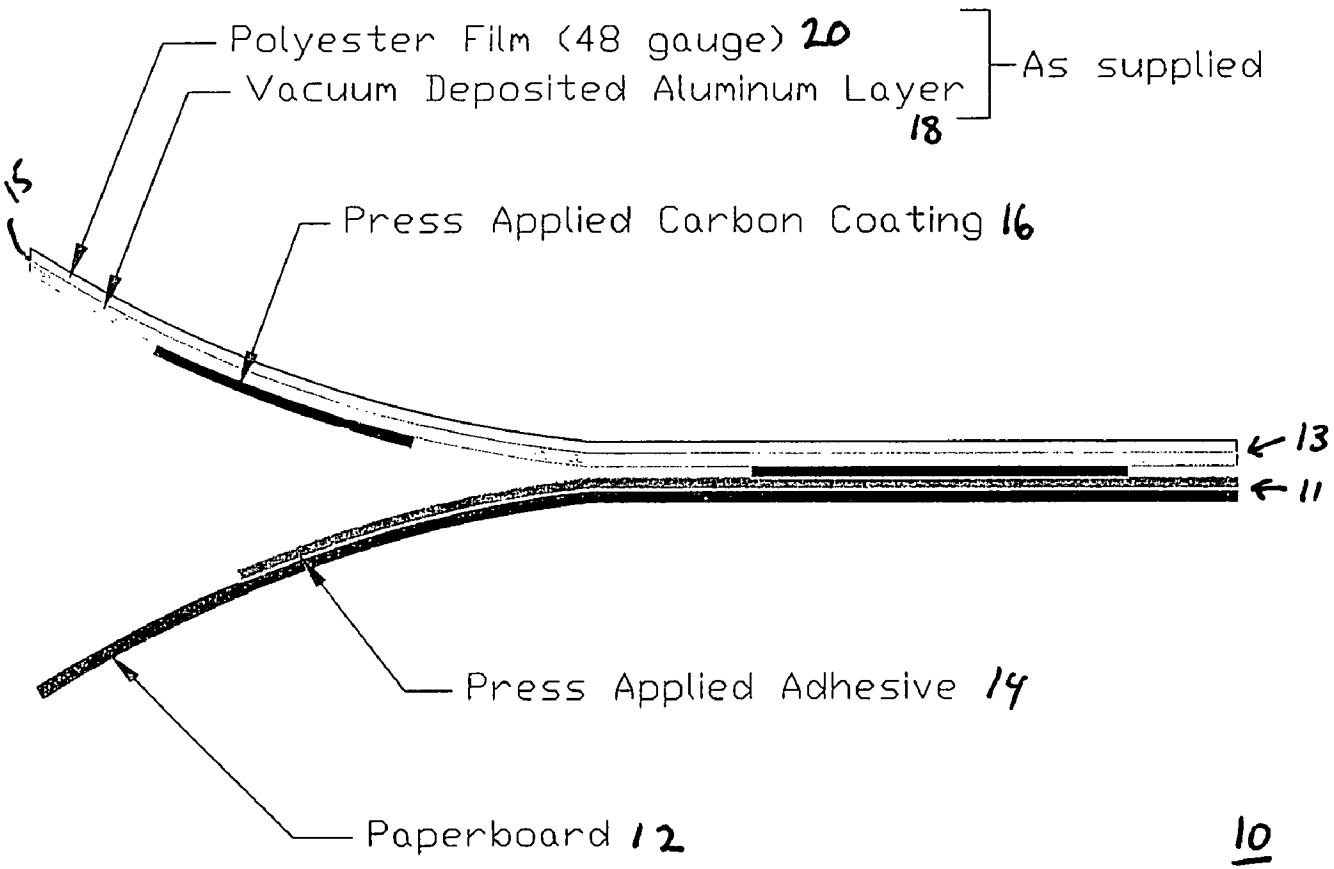
FIG. 1 shows a cross section of one embodiment of a microwave susceptor according to the present invention.

As shown in FIG. 1, disclosed herein is an improved susceptor structure 10 for cooking and browning foods in a microwave oven. The susceptor 10 outperforms conventional susceptors because it has areas 16 that generate additional heat for cooking difficult to crisp items such as pizza, egg rolls and pocket sandwiches. To provide this additional heat, a carbon-based solution 16 is applied to a metallized susceptor 15 in select areas. This selective addition of heat allows balanced cooking with less cooking time.

The susceptor 10 uses a metallized film 15 for its base temperature generation. The metallized film 15 can be any suitable metallized susceptor for use in microwave cooking. In the example shown, the metallized film 15 is a commercially-available film including a polyester film 20 having a vacuum deposited aluminum layer 18. In areas where additional heat is desired, a carbon-based press-applied coating 16 is applied. Both the pattern of the coating 16, as well as the coating formulation can vary in order to vary the amount of heat increase in the printed areas. The coating 16 can be any suitable printable dispersion containing one or more microwave-interactive compounds that absorb microwave energy, preferably carbon. The microwave-interactive compounds can also be metal, metal oxide, graphite or the like, or any combination thereof.

The printed metallized film 13 is then press laminated to a non-microwave-interactive layer 11. In the example shown, the layer 11 includes a paperboard substrate 12 coated with a press-applied adhesive 14. The layer 11 can form part of microwave food container (not shown). Suitable substrates other than paperboard can be employed.

Using the combination of metallization and carbon coating, a result comparable to conventional cooking can be achieved. Also, the susceptor 10 does not experience runaway heating like known printed carbon-based susceptors. It is believed that this is because of at least two reasons. The first is that the metallized susceptor film provides a base level of heat output. Therefore, the amount of carbon needed to achieve good results can be much less than if the carbon provides 100% of the heat. Using less carbon reduces or eliminates the chance of package ignition, which is a problem for known carbon-based susceptors. Second, the metallized film apparently cracks at high temperatures, thus limiting the heat output. This also helps to limit or prevent runaway heating.

The process steps for fabricating the susceptor 10 are:

1. A carbon-based dispersion 16 is press applied to a sheet 15 of fully metallized polyester film. Partially metallized, demetallized, and variable density metallized films can also be used. Drying of the coating 16 prior to laminating to the non-microwave-interactive layer 11 is advantageous and preferred.

2. A coating of laminating adhesive 14 is applied to cover the entire upper surface of the paperboard substrate 12. This step is preferably performed simultaneously with step 1.

3. The two sheets 11, 13 are then nipped between one or more rollers (not shown) to form a lamination 10.

In the above process, the adhesive 14 can entirely coat the paperboard 12 prior to contacting the carbon-based dispersion 16. This is advantageous because the adhesive 14 provides a barrier between the paper fibers of the substrate 12 and the dispersion 16. This is thought to reduce the possibility of package ignition because if the carbon-based coating is directly applied to paper, the paper fibers are coated with the dispersion. It is believed that these small fibers contribute to run away heating in a fashion similar to kindling in a fire. The overall coating of laminating adhesive 14 on the paper 12 further seals the paper fibers.

Another reason that the structure 10 does not produce runaway heating may be that the metallized film 15 that the carbon coating 16 is applied to is not heat stable. This provides a "thermostat" effect that occurs when the overheated film cracks. It is believed that the cracking of the metal layer 18 contributes positively to this "thermostat" effect.

Figure 2A:
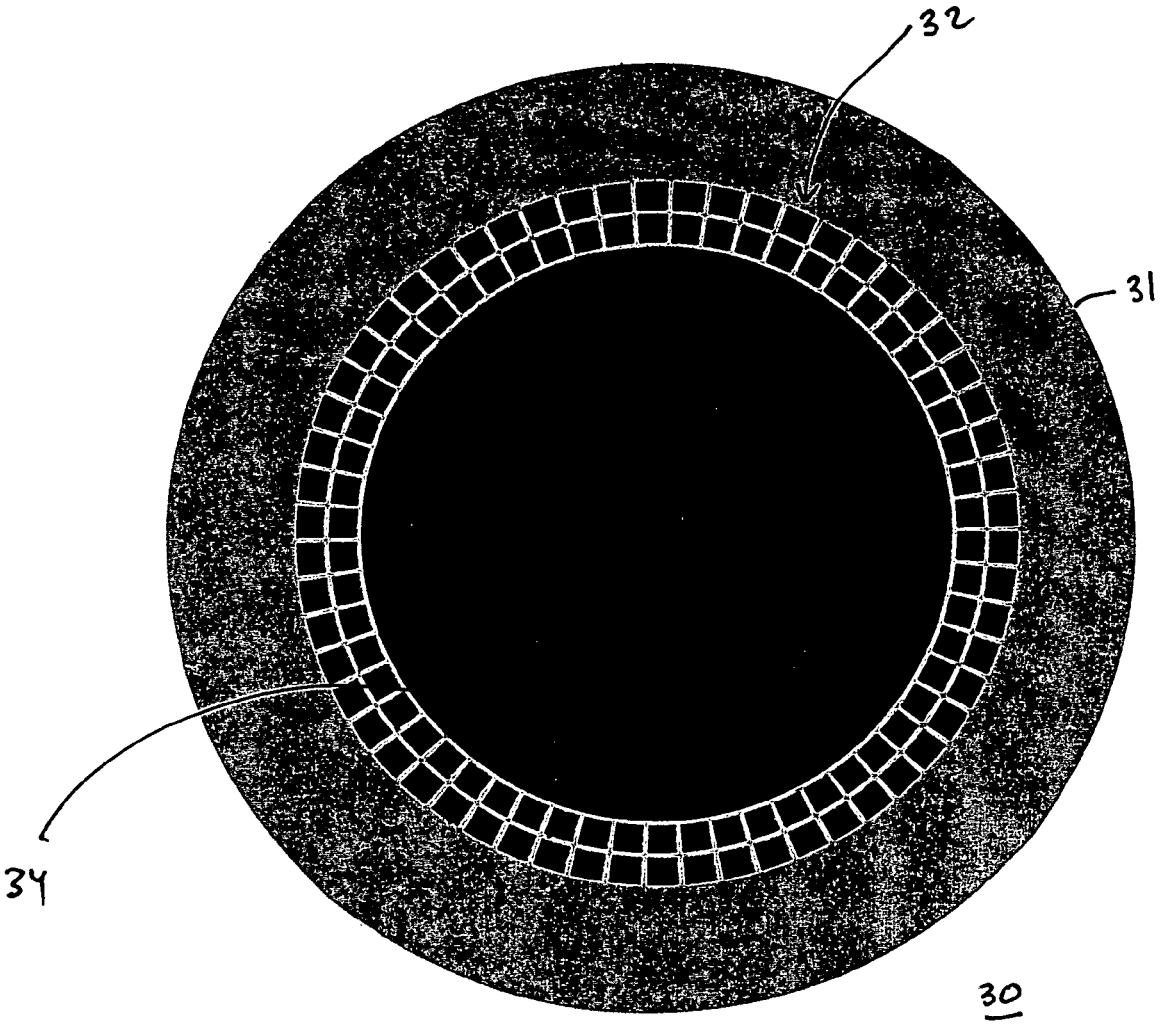
FIG. 2A shows a top view of a first embodiment of a microwave susceptor according to the present invention.
Figure 2B:
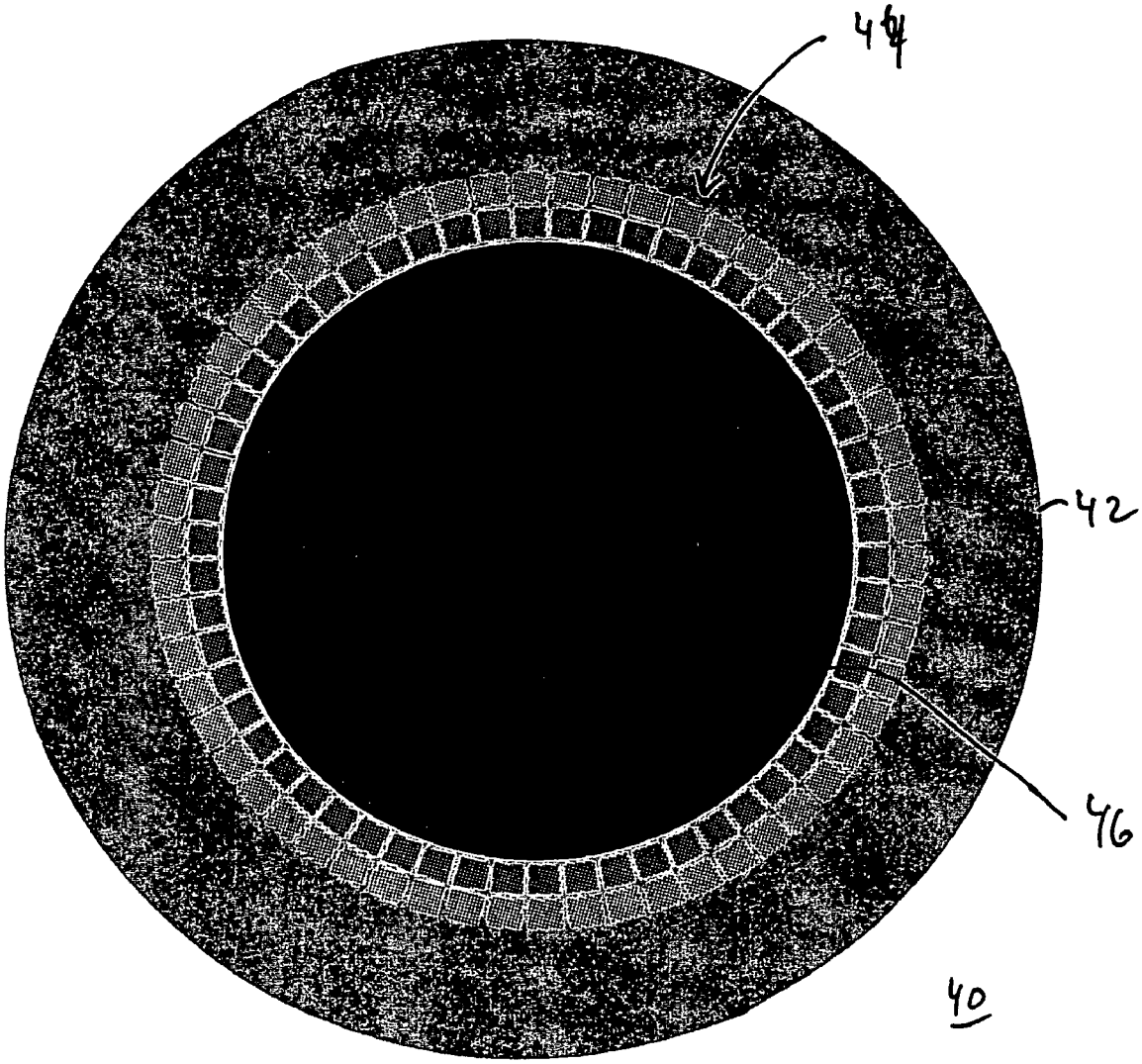
FIG. 2B shows a top view of a second embodiment of a microwave susceptor according to the present invention.
Figure 2C:
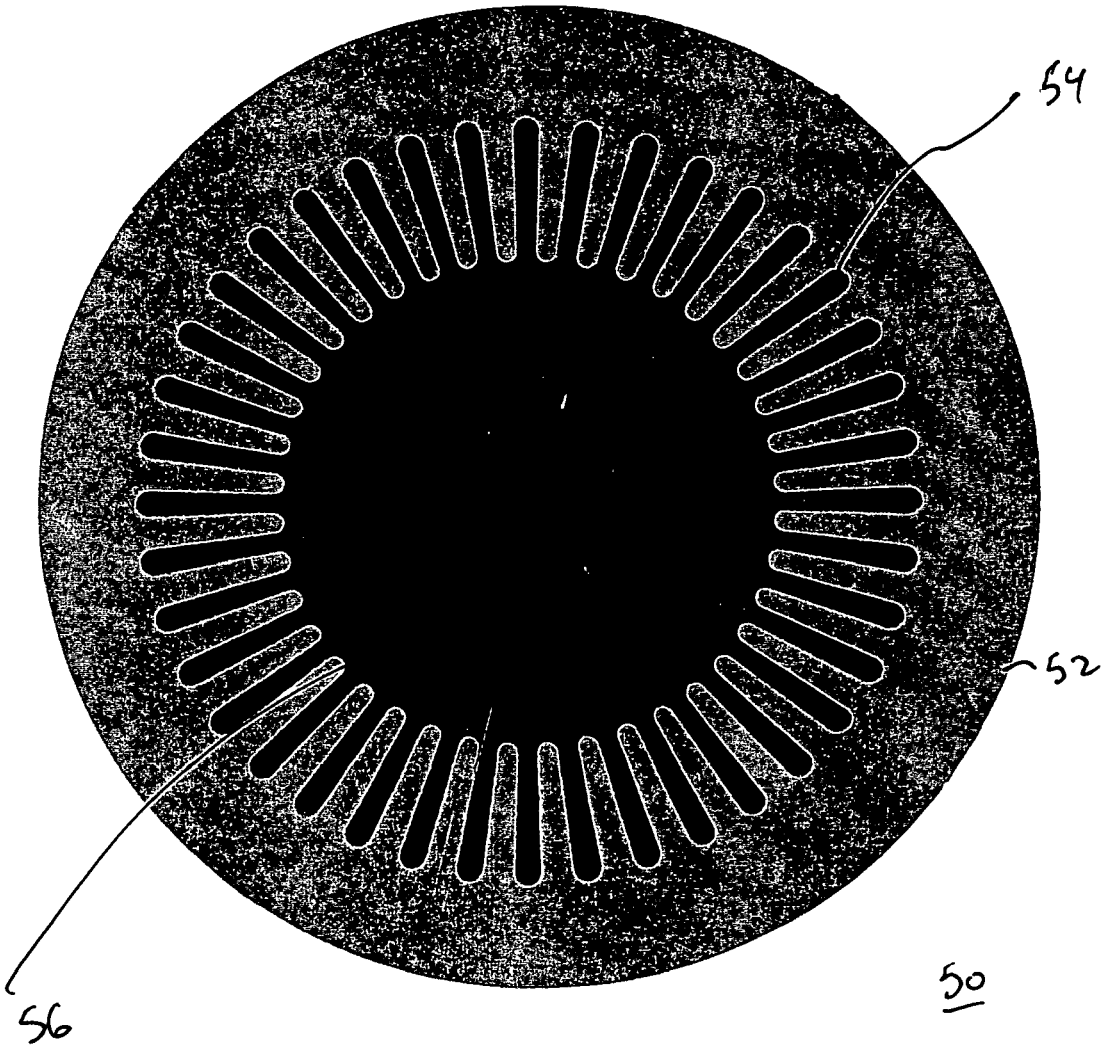
FIG. 2C shows a top view of a third embodiment of a microwave susceptor according to the present invention.

FIGS. 2A-C show examples of pattern heat zones printed on the metallized film 15. The patterns are designed to provide specific patterns of localized heating over the surface area of a susceptor, and are useful for heating different types of food.

FIG. 2A shows a first exemplary susceptor 30 having a metallized film 31 and printed thereon a carbon coating consisting of a solid center portion 34 surrounded by plural circumferential patches of coating 32.

FIG. 2B shows a second exemplary susceptor 40 having a metallized film 42 and printed thereon a carbon coating consisting of a solid center portion 46 surrounded by plural circumferential patches of coating 44 that have a varying density of carbon. As shown, the density of the carbon in the coating decreases and the distance from the center of the susceptor 40 increases.

FIG. 2C shows a third exemplary susceptor 50 having a metallized film 52 and printed thereon a carbon coating consisting of a solid center portion 56 surrounded by plural radially extending fingers of coating 54.

The density of the carbon in the coating 16 and the printed shape, area and location of the coating 16 can be any suitable value or shape for the intended purpose of the susceptor 10. Also, the shape and size of the metallized film can assume any form suitable for the intended purpose of the susceptor 10.

To obtain the coated areas 16, carbon black can be printed onto the metallized film 15 using different mixtures of the coating 16. A mixture of carbon black ink dispersion can be printed on the metallized side 18 of the polyester film 20 using a water based adhesive to act as a carrier of the carbon black and as a bonding agent. The film with the carbon black/adhesive 13 can be laminated to board stock 12 using the same adhesive used for the carbon coating 16.

According to a first exemplary coating mixture, a printing machine can be set up to run the following materials:

10.5 pt. SBS (paperboard)
Carbon Black Dispersion (CCI)
Metallized polyester (Rol-Vac)
Adhesive # 8156 (Fuller) (Both for dispersion mixture and for laminating)
Blue water based ink (CCI)
200 line anilox Carbon black/adhesive mixture—Adhesive is mixed with of carbon black for an initial weight ratio of 40% carbon black to adhesive. A circular pattern is printed using a 200 line anilox onto the metal side of the film. In this process, the printed side of the film is then laminated to the 10.5 pt. board stock. Additional carbon black can be added to the mixture to strengthen it and additional reflex blue can be added to the mixture to even out the color. The coloring is optional.

According to a second exemplary coating mixture, a printing machine can be set up to run the following materials:

10.5 pt. SBS (paperboard)
10.5 pt. Clay coated SBS (paperboard)
Carbon Black Dispersion (CCI)
Metallized polyester (Rol-Vac )
Adhesive # 8156 (Fuller) (Both for dispersion mixture and for laminating)
Blue water based ink (CCI)
Thickener #DREWTHIX 53L (Ashland)
150 line anilox A 150 line anilox is used for heavier print lay down on the metallized polyester film. A carbon black/adhesive weight ratio of greater than 40% is used. Also, 2.5 ounces of thickener per about 30 pounds of carbon black/adhesive is added to the mixture to attain more body. The printed film is then laminated to the clay coated side of the paperboard.

The disclosed microwave susceptor improves the heat output of conventional metallized susceptors, and is especially useful for foods that are difficult to crisp such as pizzas, egg rolls, breads, etc. The susceptor provides fast cooking without over cooking edges and ends of food products.

The invention claimed is:

1. A variable density microwave susceptor comprising a metallized film, a microwave-interactive coating applied to the surface of the metallized film in select areas where additional heat is desired and resulting in variable conductivity across the susceptor surface, a substrate, and a laminating adhesive layer holding the metallized film to the substrate.

2. The susceptor of claim 1 wherein the metallized film is selected from the group consisting of fully metallized, partially metallized, demetallized, and variable density metallized.

3. The susceptor of claim 1 wherein the substrate is paperboard.

4. The susceptor of claim 1 wherein the substrate is a portion of a microwave food container.

5. The susceptor of claim 1 wherein the microwave-interactive coating comprises one or more components selected from the group consisting of carbon, graphite, metal, and metal oxide.

6. The susceptor of claim 1 wherein the microwave-interactive coating is a carbon-based coating.

7. The susceptor of claim 1 wherein the microwave-interactive coating further comprises an adhesive.

8. The susceptor of claim 7, wherein the adhesive is a water-based adhesive.

* * * * *